US010579003B1

(12) United States Patent
Bacelieri et al.

(10) Patent No.: US 10,579,003 B1
(45) Date of Patent: Mar. 3, 2020

(54) COMPENSATION FOR DEFICIENT CHARGE ROLL IN AN IMAGING DEVICE

(71) Applicant: LEXMARK INTERNATIONAL, INC., Lexington, KY (US)

(72) Inventors: Michael Brian Bacelieri, Lexington, KY (US); Douglas Anthony Able, Shelbyville, KY (US); Andrew Pryse Dale, Lexington, KY (US); Jared Kuohui Lin, Lexington, KY (US); Robert Watson McAlpine, Lexington, KY (US); Matthew Russell Smither, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/418,113

(22) Filed: May 21, 2019

(51) Int. Cl.
*G03G 15/06* (2006.01)
*G03G 15/00* (2006.01)

(52) U.S. Cl.
CPC ..... *G03G 15/5037* (2013.01); *G03G 15/5004* (2013.01); *G03G 15/751* (2013.01); *G03G 15/80* (2013.01)

(58) Field of Classification Search
CPC ..... G03G 15/5037; G03G 15/5004; G03G 15/751; G03G 15/80
See application file for complete search history.

(56) References Cited

U.S. PATENT DOCUMENTS

| | | | | |
|---|---|---|---|---|
| 6,122,460 | A | 9/2000 | Meece et al. | |
| 7,643,765 | B2 | 1/2010 | Miyaji et al. | |
| 9,791,799 | B2 * | 10/2017 | Kobayashi | G03G 15/0225 |
| 2015/0071663 | A1 * | 3/2015 | Yoshioka | G03G 15/065 399/50 |

FOREIGN PATENT DOCUMENTS

| | | | |
|---|---|---|---|
| JP | 05249850 | A | 9/1993 |
| JP | 2007192941 | A | 8/2007 |

* cited by examiner

*Primary Examiner* — Hoang X Ngo

(57) ABSTRACT

An imaging device includes a photoconductive drum charged by a charge roll and opposed by a transfer roll to transfer an image from the drum. The drum becomes biased to a negative voltage by setting charges of negative voltage on both the charge roll and transfer roll. A controller switches the bias of the transfer roll to a positive voltage from the negative voltage and a delta or difference in a charge of the drum is determined from before and after the switching. Based on the delta, the voltage on the charge roll is boosted by a boost voltage to improve the charge on the drum. In this way, deteriorating or defective charge rolls can be still used to charge the drum to a proper voltage for imaging. Techniques for determining the delta, the boost and the magnitude of voltage charges are further embodiments.

20 Claims, 3 Drawing Sheets

140

| Index | ΔV | Charge boost | Laser Power Boost (%) |
|---|---|---|---|
| 0 | 0 Vdc - ≤ 175 Vdc | 0 Vdc | 0 |
| 1 | 175 Vdc - ≤ 225 Vdc | 33 Vdc | 2 |
| 2 | 225 Vdc - ≤ 275 Vdc | 67 Vdc | 2 |
| 3 | 275 Vdc - ≤ 325 Vdc | 92 Vdc | 4 |
| 4 | 325 Vdc - ≤ 375 Vdc | 125 Vdc | 4 |
| 5 | > 375 Vdc | 150 Vdc | 6 |

140

| Index | ΔV | Charge boost | Laser Power Boost (%) |
|---|---|---|---|
| 0 | 0 Vdc - ≤ 175 Vdc | 0 Vdc | 0 |
| 1 | 175 Vdc - ≤ 225 Vdc | 33 Vdc | 2 |
| 2 | 225 Vdc - ≤ 275 Vdc | 67 Vdc | 2 |
| 3 | 275 Vdc - ≤ 325 Vdc | 92 Vdc | 4 |
| 4 | 325 Vdc - ≤ 375 Vdc | 125 Vdc | 4 |
| 5 | > 375 Vdc | 150 Vdc | 6 |

FIG. 3

COMPENSATION FOR DEFICIENT CHARGE ROLL IN AN IMAGING DEVICE

The present disclosure relates to the electrophotographic (EP) process in imaging devices, such as printers, copiers, all-in-ones, multi-function devices, etc. It relates further to identifying and compensating for problems related to deficient or defective charge rolls that charge photoconductive (PC) drums during imaging.

BACKGROUND

The EP process includes a laser discharging a charged PC drum to create a latent image that becomes toned with one or more toners (e.g., black, cyan, magenta, yellow). A voltage difference between the drum and an opposed transfer roll transfers the image to a media sheet or to an intermediate transfer member (ITM) for subsequent transfer to a media sheet. A corona or charge roll sets the charge on the PC drum and a developer roll introduces the toner to the latent image. A controller coordinates with one or more high voltage power supplies to provide power to the laser and to set relevant charges on the rolls. As is known, the control of the surface voltage potential on the PC drum is highly critical to a well-performing EP process, not only for image development, but also for minimizing waste toner.

However, it has been observed in many imaging devices that, with aging components, variability increases, especially for charge rolls. It occurs for many reasons but includes variation in the wear rates of the rolls and influences from environmental conditions, the nature of a customer run mode, and the composition of the rolls. The ability to compensate for each of these variables independently using crude open loop adjustments can be extremely difficult. Therefore, a need exists to accurately detect, and compensate, the PC surface voltage dynamically throughout the life of a machine. The inventors note this type of detection would then allow the imaging device to apply a proper charge compensation and prevent unwanted background/waste toner development when the charge levels drift above or below desired set points.

As has also been observed, charge voltage compensation in imaging devices is often performed through one or more of the following options: (1) using a set of preconditions and open loop modifications derived from empirical test data; (2) adding circuitry to the high voltage power supply to provide direct current feedback of the charge roller; (3) using an optical density sensor to detect unwanted background toner; (4) using a weather station to compensate for environmental conditions; and (5) using an electrostatic probe as precise feedback to known the surface potential of the drum. Although the first option provides less expense for an imaging device, it likely results in higher amounts of variation. The latter four options, however, can provide the most direct feedback for proper compensation, but for more economical imaging devices they are costly additions to the bill of materials. A need exists to overcome these and other problems.

SUMMARY

The embodiments described herein relate to methods and apparatus that identify and compensate for insufficient charge on the PC drum in color or monochromatic imaging devices. In one design, the imaging device includes a drum charged by a charge roll and opposed by a transfer roll to transfer an image from the drum. The drum becomes biased to a negative voltage by setting charges of negative voltage on both the charge roll and transfer roll. In this state, the transfer roller assists the charge roll in supplying necessary current to properly charge the drum. A controller in communication with a high-voltage power supply next switches the bias of the transfer roll to a positive voltage from the negative voltage whereupon the charge roll becomes fully responsible for charging the drum to desired levels. When charging performance of the drum is poor, the charge roller is unable to maintain the desired level and the surface voltage of the drum decays over time. A delta or difference in a charge of the drum from before and after the switching is determined by the controller. Based on the delta, the voltage on the charge roll is boosted by a boost voltage to improve the charge on the drum. In this way, deteriorating or defective charge rolls can be still used to charge the drum to a proper voltage for imaging. Techniques for determining the delta, the boost, and the magnitude of voltage charges are further embodiments, to name a few. In other designs, methods and apparatus take advantage of transfer roll feedback circuitry already existing in many imaging devices to detect the charge on the drum.

DRAWINGS

FIG. 3 is a table for boosting charge for charge rolls.

DETAILED DESCRIPTION OF THE EMBODIMENTS

Figure 1:
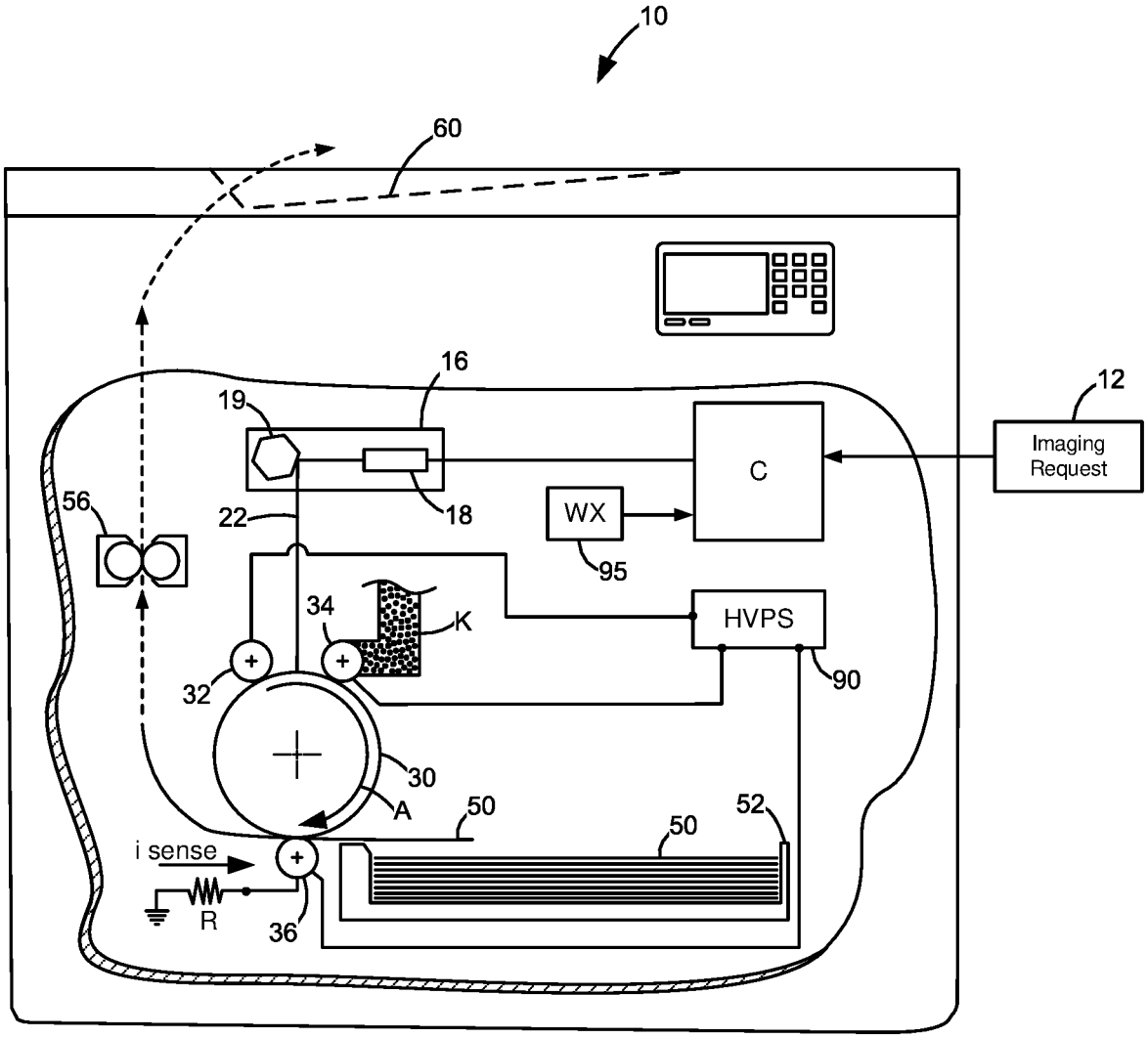
FIG. 1 is a diagrammatic view of an imaging device including compensation for deficient or defective charge rolls.

FIG. 1 teaches an imaging device 10 having compensation for deficient charge rolls. The device is black only (shown) or color-imaging capable (not shown). The device receives at a controller, C, an imaging request 12. The controller typifies an ASIC(s), circuit(s), microprocessor(s), firmware, software, or the like. The request comes from external to the imaging device, such as from a computer, laptop, smart phone, etc. It can also come internally, such as from a copying request. In any, the controller converts the request to appropriate signals for providing to a laser scan unit 16. The unit turns on and off a laser 18 according to pixels of the imaging request. A rotating mirror 19 and associated lenses, reflectors, etc. (not shown) focus a laser beam 22 onto a photoconductive drum 30, as is familiar, or plural drums for color imaging (not shown). The drums correspond to supplies of toner, such as yellow (y), cyan (c), magenta (m) or black (k). A charge roll 32 sets a charge on a surface of the drum 30 as the drum rotates. The laser beam 22 electrostatically discharges the drums to create a latent image. A developer roll 34 introduces toner to the latent image and such is electrostatically attracted to create a toned image on a surface of the drum. A voltage differential between the surface of the drum 30 and an opposed transfer roll 36 transfers the toned image direct from the drum to a sheet of media 50 or indirect to an intermediate transfer member (not shown) for subsequent transfer to the media. The sheet advances from a tray 52 to a fuser assembly 56 to fix the toned image to the media through application of heat and pressure. Users pick up the media from a bin 60 after it advances out of the imaging device. The controller coordinates the operational conditions that facilitate the timing of the image transfer and transportation of the media from tray to output bin. The controller also coordinates with a high voltage power supply 90 to set the relative voltages for electrophotgraphic image process, including setting the charge for the charge roll 32, the developer roll 34 and transfer roll 36.

To periodically identify whether or not the charge roll has become deficient, the controller implements an algorithmic routine. The routine is triggered for execution per a given page count of media imaged, such as 250 pages, whenever a new imaging unit or cartridge containing the drum and charge roll is installed in the device, at the end of an imaging request, every power-on cycle, upon a door open/close event, or at other times. Operational conditions may be also considered when initiating the routine, such as accepting input from a weather station 95 regarding relative humidity and temperature. It has been found that the routine functions better above 50° F. and/or above 15% relative humidity. Still other considerations include operating the imaging device at full process speed during execution of the routine, such as 40 pages per minute, instead of half-process speed or at speeds slower than full.

Regardless, once triggered, the routine consists of first biasing the drum to a negative voltage by setting the charge roll to a negative voltage and setting the transfer roll to a negative voltage. This includes, but is not limited to, charging the surface of the drum to approximately −600 Vdc by setting the voltage on the charge roll to about −1200 Vdc and on the transfer roll to about −1000 Vdc. The magnitude of voltage is not so limited to the values given, but the magnitude of the voltage of the transfer roll should not exceed the magnitude of the voltage of the charge roll so as to implicate charging the drum in greater proportion than the contribution of the charge roll. Rather the negative voltage of the transfer roll is only provided to assist the charging of the drum by the charge roll. The voltage of the transfer roll should be also at least as great as the Paschen breakdown voltage of the drum, whatever that value, and such varies according to the composition of the materials of the drum, as is known. The routine continues the charging of the drum in this fashion for so long as needed to achieve a sort of steady-state of surface voltage on the drum. It has been found satisfactory that a period of about fourteen or more revolutions of the drum will reach the desired surface voltage.

Preceding this, however, there can also exist a sort of pre-conditioning of the drum whereby the transfer roll is set to a positive voltage to discharge the drum before setting both the charge roll and the transfer roll to negative voltages. In this way, the pre-conditioning of the drum harmonizes each execution of the charge roll compensation algorithm. It sets a baseline, of sorts, by which to begin the process. The positive voltage on the transfer roll also need last for at least one full revolution of the drum plus the distance from the charge roll to the transfer roll as noted by arrow A. The magnitude of the positive voltage is anything great than 0 V, but the higher the positive voltage the greater the discharge of the drum before initiating the compensation routine and the setting of negative voltages on both the charge and transfer rolls.

To determine or infer the value of the surface charge on the drum, the controller senses the current $i_{sense}$ to the transfer roll 36 through the resistor R connected to ground for at least the time it takes to complete at least one full revolution of the transfer roll. In turn, the current may be averaged over this time, or its mean determined, or evaluated through other signal processing techniques. Once measured, the controller switches positive the voltage on the transfer roll in a range from about +500 to about +4500 Vdc, with an optimal voltage existing at about +2500 Vdc. The surface voltage of the drum is again inferred by sensing again the current $i_{sense}$ to the transfer roll 36 through the resistor R. The second instance of measuring the current occurs at any time after the switch in voltage on the transfer roll from negative to positive but has been found satisfactory to sense the current after about five full revolutions of the drum.

Figure 2:
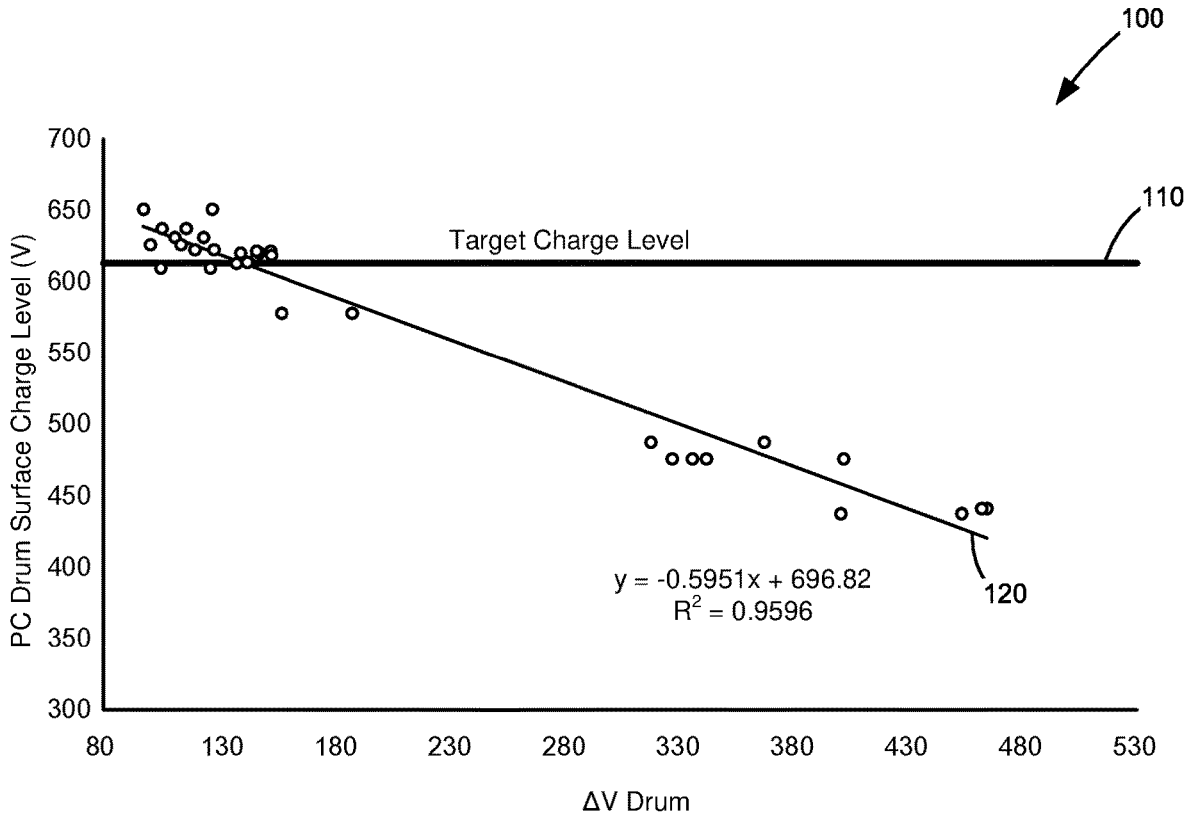
FIG. 2 is a graph of representative data characterizing charge rolls.

With reference to the graph 100 of FIG. 2, there now exists a known delta (Δ) or difference in the voltage in the surface charge of the drum from when the transfer roll voltage was negative to when the transfer voltage was switched to positive. The delta voltage (ΔV) (x-axis) can be graphed relative to a surface charge on the PC drum (y-axis), including noting a target surface charge level of the drum 110, in this instance defined at −610 Vdc or |610 Vdc|. Representative data points are also scattered on the graph that have been empirically found from execution of the routine, including their approximation given by the straight line 120. This graph, along with many other iterations of executing the algorithm, has resulted in the inventors noting that a properly functioning or acceptably operable charge roll occurs when the delta voltage (ΔV) exists at about 175 Vdc or less. Deficient charge rolls in an imaging device, on the other hand, have been noted at greater than 175 Vdc and that the greater the delta voltage of the drum, from before and after switching the transfer roll from negative voltage to positive voltage, the greater the compromise or deficiency of the charge roll.

With reference to the table 140 of FIG. 3, the inventors have characterized the amount of voltage needed in a deficient charge roll to boost its operating condition back to an acceptable performance. They have also demarked acceptably operable charge rolls from deficient ones. In this instance, acceptably operable charge rolls correspond to those having a (ΔV) of 175 Vdc or less. In turn, no boost voltage or charge boost is needed for the charge roll when charging the drum. Greater than 175 Vdc, however, charge rolls require a boost in voltage in order to properly assist the imaging function to improve the surface charge on the drum. For example, if the controller normally sets the voltage on the charge roll to −1200 Vdc to cause −600 Vdc on the surface of the PC drum, charge rolls characterized at Index 1 would further require a boost voltage of magnitude 33 Vdc, thereby causing the controller to set the voltage on the charge roll at −1233 Vdc the charge, or |1200 Vdc|+|33 Vdc|=|1233 Vdc|. Similarly, those charge rolls falling into: Index 2 would need a boost voltage of 67 Vdc; Index 3 would need a boost voltage of 92 Vdc; Index 4 would need a boost voltage of 125 Vdc; and Index 5 would need a boost to 150 Vdc. In this regard, skilled artisans will note that the grouping of voltage ranges includes at least six ranges, six indices from 0-5, with four of the six ranges including about fifty volts ΔV, and a corresponding boost voltage in a range of 25 (from Index 2 to Index 3) to 35 Vdc (from Index 3 to Index 4), but that the invention should not be so limited. Through empirical study other ranges are anticipated as being acceptable to boost the voltage on the charge roll to improve the surface charge on the drum as a function of the properties of the roll and drum, their sizes, the power supply, and similar other factors.

Lastly, the inventors have also recognized that other operating conditions can be used to improve the operation of deteriorating or defective charge rolls. In one instance, the inventors further recognize that in addition to, or separately from the boost voltage, the power of the laser 18 (FIG. 1)

that discharges the drum can be boosted by increasing the laser power. If characterizing laser power as a percentage from 0% to 100%, the boost for the indices 0, 1, 2, 3, 4, and 5 corresponds to a boost in laser power of 0%, 2%, 2%, 4%, 4% and 6%, respectively. Artisans will also understand that the percentage will likely require manipulation of code by the controller to interface properly with the laser programming interface as set by the manufacturer of the laser. Lastly, the values in the Table 140 of FIG. 3 and other values can be stored in memory (M) (FIG. 1) for access by the controller during use.

The foregoing description of several methods and example embodiments has been presented for purposes of illustration. It is not intended to be exhaustive or to limit the claims. Modifications and variations to the description are possible in accordance with the foregoing. It is intended that the scope of the invention be defined by the claims appended hereto.

The invention claimed is:

1. In an imaging device having a photoconductive drum charged by a charge roll and opposed by a transfer roll to transfer an image from the drum, a method comprising:

biasing the drum to a negative voltage by setting each of the charge roll and transfer roll to negative voltages;

switching the negative voltage on the transfer roll to a positive voltage;

inferring a difference in a charge on the drum from the switching the transfer roll from the negative voltage to the positive voltage; and based on the difference in the charge, boosting a voltage on the charge roll to improve the surface charge on the drum.

2. The method of claim 1, wherein setting the negative voltage on the transfer roll includes setting the negative voltage in magnitude not to exceed the negative voltage on the charge roll.

3. The method of claim 1, further including grouping into voltage ranges the difference in the charge on the drum to categorize the boosting of the voltage on the charge roll.

4. The method of claim 1, wherein the switching the transfer roll to the positive voltage further includes switching the positive voltage in a range from +500 Vdc to +4500 Vdc inclusive.

5. The method of claim 4, further including switching the positive voltage to about +2500 Vdc.

6. The method of claim 1, further including based on the difference in charge boosting a laser power of a laser that discharges the drum.

7. The method of claim 1, wherein setting the transfer roll to the negative voltage includes setting the negative voltage in magnitude greater than a Paschen breakdown voltage of the drum.

8. The method of claim 1, further including keeping a boost voltage on the charge roll for about 250 pages of imaging and inferring again the difference in charge on the drum to determine a next boost voltage.

9. The method of claim 1, further including determining a temperature and humidity in which the imaging device is operating.

10. The method of claim 1, further including detecting installation of a new imaging unit.

11. The method of claim 1, further including running the imaging device at full process speed.

12. In an imaging device having a photoconductive drum charged by a charge roll and opposed by a transfer roll to transfer an image from the drum, a method comprising:

biasing the drum to a negative voltage by setting each of the charge roll and transfer roll to negative voltages and setting the negative voltage of the transfer roll in magnitude not exceeding the negative voltage of the charge roll;

switching the negative voltage on the transfer roll to a positive voltage;

inferring a difference in a surface charge on the drum from the switching transfer roll from the negative voltage to the positive voltage; and based on the difference in surface charge, boosting a voltage on the charge roll to improve the surface charge on the drum, including grouping into voltage ranges the difference in the surface charge on the drum to categorize into boost voltages the boosting of the voltage on the charge roll.

13. The method of claim 12, further including measuring a current supplied to the transfer roll, the measuring occurring at a time when the transfer roll is biased with the negative voltage.

14. The method of claim 12, further including measuring a current supplied to the transfer roll, the measuring occurring at a time when the transfer roll is biased with the positive voltage.

15. The method of claim 12, further including measuring a first and second current supplied to the transfer roll, the measurement of the first current occurring when the transfer roll is biased with the negative voltage and the measurement of the second current occurring when the transfer roll is biased with the positive voltage.

16. The method of claim 15, wherein the first and second currents are used to said infer the difference in the surface charge on the drum.

17. The method of claim 12, wherein the switching the transfer roll to the positive voltage further includes switching the positive voltage in a range from +500 Vdc to +4500 Vdc inclusive.

18. The method of claim 17, further including switching the positive voltage to about +2500 Vdc.

19. The method of claim 12, wherein setting the transfer roll to the negative voltage includes setting the negative voltage in magnitude greater than a Paschen breakdown voltage of the drum.

20. The method of claim 12, further including grouping the voltage ranges into at least six ranges, four of the six ranges including about fifty volts, one of the six ranges being less than about 175 volts, and the other of the six ranges being greater than about 375 volts.

* * * * *